US007614609B1

(12) United States Patent
Yang et al.

(10) Patent No.: US 7,614,609 B1
(45) Date of Patent: Nov. 10, 2009

(54) WINCH

(75) Inventors: Huizhong Yang, Hang Zhou (CN); Zhaobo Qing, Hang Zhou (CN)

(73) Assignee: T-Max (Hang Zhou) Industrial Co., Ltd. (CN)

( * ) Notice: Subject to any disclaimer, the term of this patent is extended or adjusted under 35 U.S.C. 154(b) by 0 days.

(21) Appl. No.: 12/344,818

(22) Filed: Dec. 29, 2008

(30) Foreign Application Priority Data

Oct. 29, 2008 (CN) ..... 2008 1 0225416

(51) Int. Cl.
*B66D 1/22* (2006.01)

(52) U.S. Cl. ..... 254/344; 254/345; 254/346; 254/347; 254/366

(58) Field of Classification Search ..... 254/344–347, 254/366, 362, 323
See application file for complete search history.

(56) References Cited

U.S. PATENT DOCUMENTS

| | | | | |
|---|---|---|---|---|
| 4,227,680 | A * | 10/1980 | Hrescak | 254/344 |
| 4,461,460 | A * | 7/1984 | Telford | 254/344 |
| 4,545,567 | A | 10/1985 | Telford et al. | 254/344 |
| 4,736,929 | A * | 4/1988 | McMorris | 254/344 |
| 5,842,684 | A * | 12/1998 | Aho | 254/344 |
| 5,860,635 | A * | 1/1999 | Morfitt et al. | 254/377 |
| RE36,216 | E | 6/1999 | Telford | 254/375 |
| 6,604,731 | B2 * | 8/2003 | Hodge | 254/344 |
| 6,663,086 | B2 * | 12/2003 | Huang | 254/344 |
| 7,000,904 | B2 * | 2/2006 | Huang | 254/323 |
| 7,527,245 | B2 * | 5/2009 | Lesko | 254/344 |
| 2003/0111654 | A1 * | 6/2003 | Huang | 254/344 |
| 2007/0227835 | A1 | 10/2007 | Elliott | 188/30 |

FOREIGN PATENT DOCUMENTS

JP 54008356 A * 1/1979

* cited by examiner

*Primary Examiner*—Emmanuel M Marcelo
(74) *Attorney, Agent, or Firm*—Bliss McGlynn, P.C.

(57) ABSTRACT

A winch including a drum, a motor and a power transmission device. The power transmission device includes a casing and a planetary mechanism assembly having first and second planetary carriers rotatably disposed in the casing; first to third planetary gears rotatably supported on the first and second planetary carriers and engaged with the transmission gear; an annular gear fixed in the casing and engaged with the first to third planetary gears respectively; and a power output member having an input gear portion and an output gear portion, the input gear portion engages with the first to third planetary gears respectively, and the output gear portion engages with the inner drum gear portion of the drum. The winch achieves deceleration function with large speed ratio by a single stage planetary mechanism.

10 Claims, 7 Drawing Sheets

WINCH

BACKGROUND OF THE INVENTION

1. Field of the Invention

The present invention relates, generally, to a winch, and more particularly, to an electric winch for automobile.

2. Description of the Related Art

An electric winch for automobile is a vehicle-carried apparatus used for vehicle rescue, loading/unloading, or cargo lifting etc, which can be mounted on an engineering vehicle, an off road vehicle, SUV sports vehicle, etc.

U.S. Pat. No. 4,545,567 discloses one example of a winch known in the related art. The power transmission device of the above conventional winch employs a multi-stage series-connected planetary mechanism to achieve deceleration function with large speed ratio and has a complicated structure.

However, the power transmission device of the conventional winch has a complicated structure with low transmission efficiency. Thus, the self-weight of the winch and the number of the components thereof increase accordingly. In addition, the manufacturing and assembling of the winch are complicated with high cost.

U.S. Pat. No. Re. 36,216 discloses another example of a winch known in the related art. However, the braking mechanism of the winch is very complicated. Therefore, manufacturing and assembling of winch are complicated, the cost and failure rate thereof are high. In addition, the maintenance is difficult with high cost.

SUMMARY OF THE INVENTION

The present invention is intended to resolve at least one of the technical problems occurring in the conventional winch. Therefore, one object of the present invention is to provide a winch in which a power transmission device employs a single stage planetary mechanism to achieve deceleration function with large speed ratio. In addition, the transmission efficiency of the present invention is high, the structure is simple, the weight is light and the cost is low.

The winch according to one embodiment of the present invention includes a drum defining an axial central hole and being rotatable about a longitudinal axis of the axial central hole. A motor is longitudinally disposed at an end of the drum, and a power transmission device is longitudinally disposed at the other end of the drum and operatively connected to the motor and the drum respectively. The power transmission device includes a casing mounted at the other end of the drum. A transmission gear shaft extends longitudinally in the axial central hole of the drum where a proximal end of the transmission gear shaft is connected to the motor and a distal end thereof is provided with a transmission gear and extends into the casing. The winch also includes a planetary mechanism assembly having first and second planetary carriers that are disposed in the casing and rotatable about the longitudinal axis. First to third planetary gears are rotatably supported on the first and second planetary carriers via first to the third planetary gear shafts and engaged with the transmission gear, respectively. An annular gear is fixed in the casing and engaged with the first to third planetary gears respectively. A power output member is disposed in the casing, rotatable about the longitudinal axis and formed with an input gear portion and an output gear portion. The input gear portion engages with the first to third planetary gears respectively, and the output gear portion engages with the drum.

The power transmission device of the winch according to embodiments of the present invention achieves deceleration function with large speed ratio by employing a single stage planetary mechanism. In addition, the transmission efficiency is high, the structure is simple, the weight is light and the cost is low.

Each of the first to third planetary gears is divided into two portions in axial direction so that the transmission gear and the planetary gears can be conveniently engaged with or disengaged from each other through moving the transmission gear shaft, thus easily achieving the engaging/disengaging function of the winch.

In addition, the fixing strength of the annular gear in the casing can be increased by forming the casing gear portion to be engaged with the annular gear, thus preventing the annular gear from being unintentionally moved.

The braking device of the winch according to embodiments of the present invention has a simple structure with low manufacturing cost and reliable braking capability, and is not apt to fail.

Other objects, features, and advantages of the present invention will be readily appreciated as the same becomes better understood while reading the subsequent description taken in conjunction with the accompanying drawings.

DETAILED DESCRIPTION OF THE INVENTION

Figure 1:
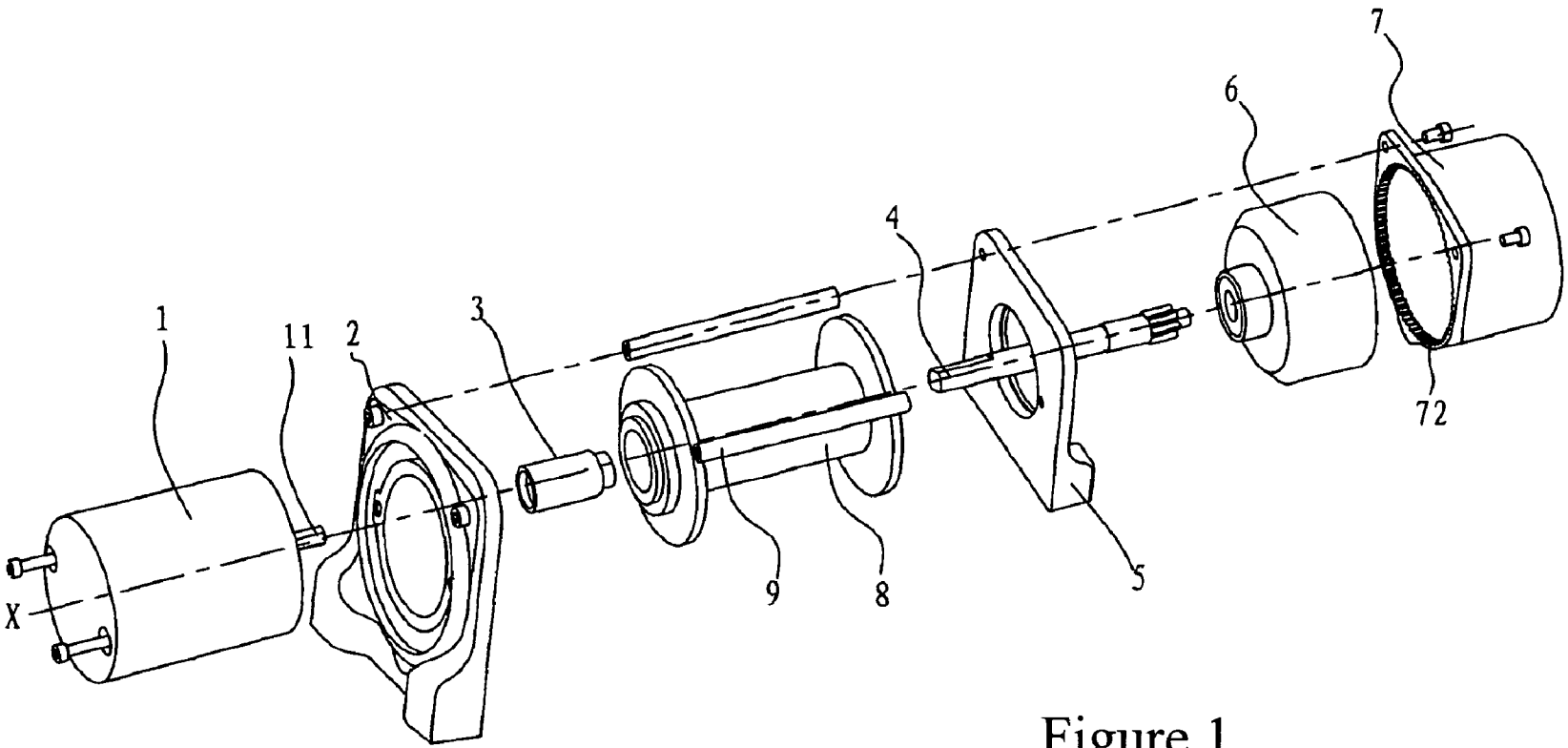
FIG. 1 is a schematic exploded view of a winch according to one embodiment of the present invention.

Reference will be made in detail to embodiments of the present invention. The same or similar elements and the elements having same or similar functions are denoted by like reference numerals throughout the descriptions. The embodiments described herein with reference to drawings are explanatory, illustrative, and used to generally understand the present invention. The embodiments shall not be construed to limit the present invention.

It should also be noted that, in the present invention, terms indicating positional relationships such as “left”, “right”, “longitudinal” etc. are based on those shown in the accompanying drawings, which is only used for illustration purpose and can not be construed to limit the present invention. The winch according to an embodiment of the present invention will described with reference to accompanying drawings below.

Figure 3:
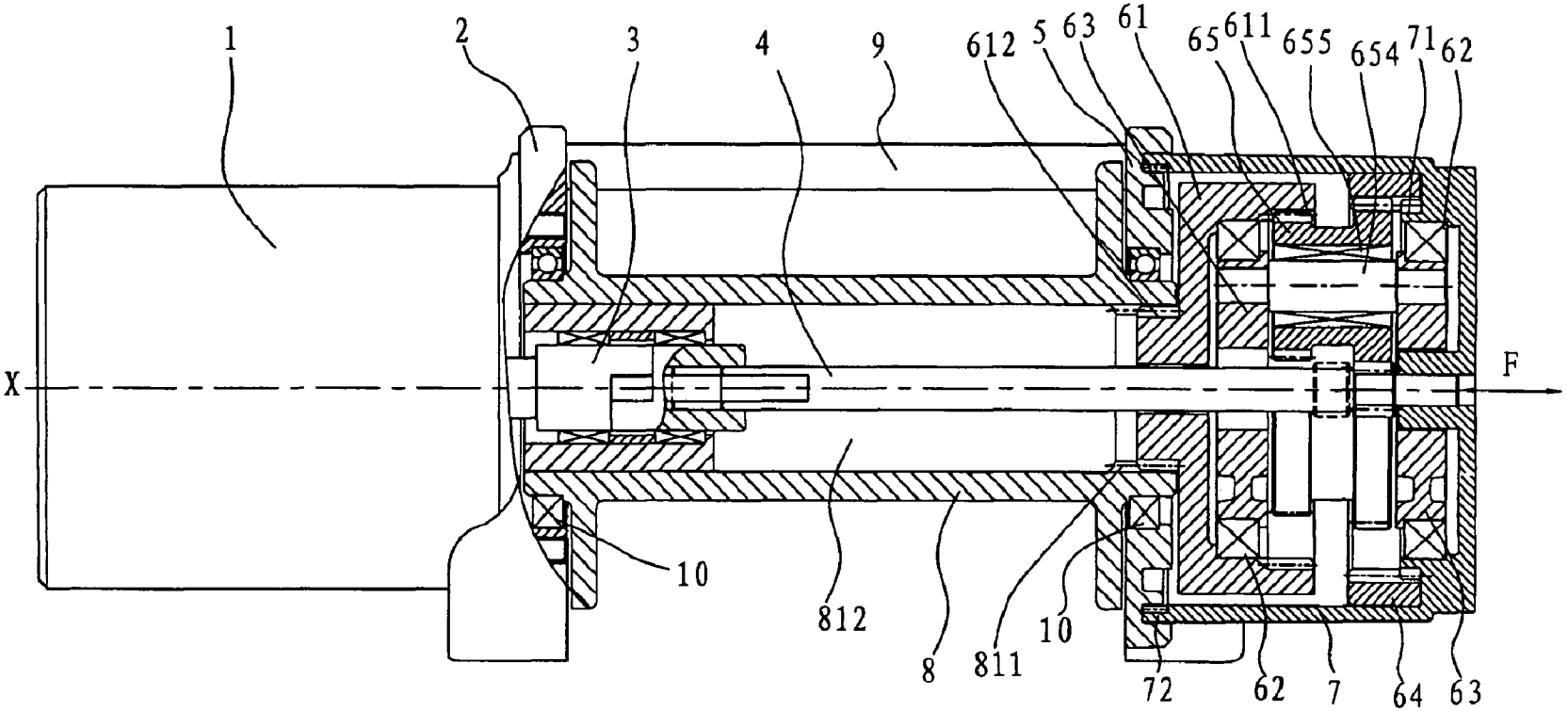
FIG. 3 is a schematic sectional view of the winch according to one embodiment of the present invention.
Figure 4:
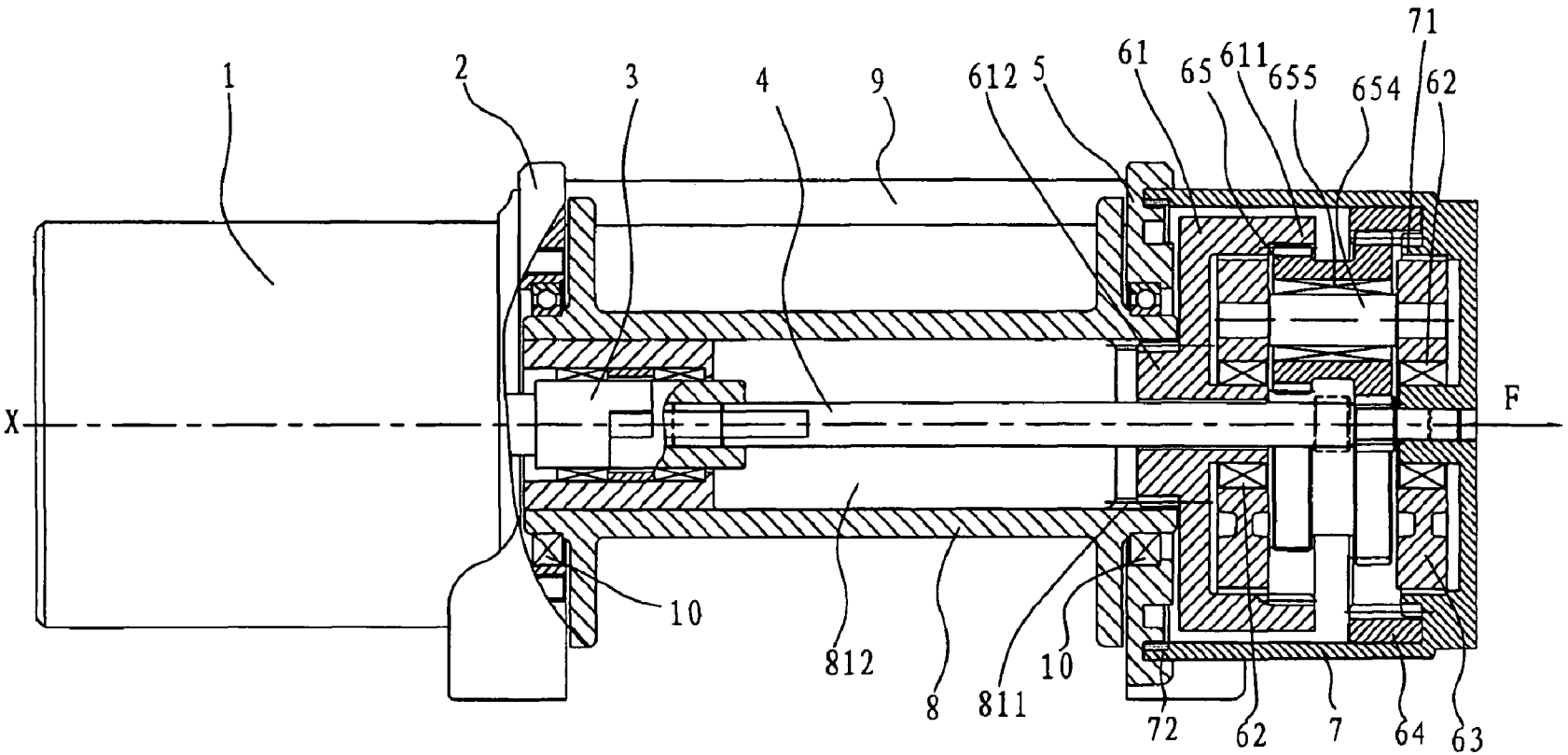
FIG. 4 is a schematic sectional view of the winch according to another embodiment of the present invention.

As shown in FIG. 1, the winch according to one embodiment of the invention includes a motor 1, a drum 8 and a power transmission device. The drum 8 has a hollow cylindrical shape. More specifically, the drum 8 has an axial central hole 812. Both ends of the drum 8 are supported on the motor support structure 2 and the casing support structure 5 via bearings 10, as shown in FIGS. 3 and 4, so that the drum 8 can rotate about a longitudinal axis X. The motor support structure 2 and the casing support structure 5 are to be mounted on the automobile respectively, so that the drum 8 can be rotatably supported on the automobile. A cable used to provide winching functionality is wound around the drum 8. The cable can be wound onto/unwound from the drum 8 by the rotation of the drum 8 as is commonly known in the art. Further, in order to increase bulk strength of the winch, a plurality of connecting bars 9 are connected between the motor base 2 and the casing base 5, and both ends of each connecting bar 9 are fixed to the motor base 2 and the casing base 5 respectively.

The motor 1, such as a reversible motor, is mounted at an end of the drum 8 in the longitudinal direction (right left direction in FIG. 4). More specifically, the motor 1 is mounted on the motor support structure 2 and an output shaft 11 thereof is extended toward the drum 8.

The power transmission device is longitudinally mounted at the other end of the drum 8 and operatively connected with the motor 1 and the drum 8 respectively, so that the driving force (torque) of the motor 1 can be transmitted to the drum 8. Here, the term of "operatively" means that the motor 1, the power transmission device and the drum 8 are connected in turn and the driving force (torque) of the motor 1 can be transmitted to the drum 8 via the power transmission device so that the drum 8 is driven to rotate by the motor 1.

According to one embodiment of the present invention, as shown in FIGS. 2-5, the power transmission device comprises a casing 7, a transmission gear shaft 4 and a planetary mechanism assembly 6. The casing 7 is mounted at the other end of the drum 8. Specifically, the casing 7 is mounted on the casing base 5. For example, as shown in FIGS. 1 and 3-5, a mounting gear portion 72 is formed in the inner circumferential wall of an opening at the left side of the casing 7. The mounting gear portion 72 engages with a gear portion of the casing base 5 so as to increase the connecting strength of the casing 7 with the casing base 5.

The transmission gear shaft 4 is longitudinally extended in the axial central hole 812 of the drum 8. The proximal end 42 of the transmission gear shaft 4 is connected with the motor 1 and the distal end thereof is provided with a transmission gear 41 and extended into the casing 7 so as to be connected with the planetary mechanism assembly 6. The transmission gear 41 can be a separated gear mounted at the distal end of the transmission gear shaft 41. Alternatively, the transmission gear 41 can be integrally formed with the transmission gear shaft 4.

The planetary mechanism assembly 6 is disposed in the casing 7 and includes two planetary carriers 63, three planetary gears 65, an annular gear 64 and a power output member 61. The planetary carriers 63 are disposed in the casing 7 and are rotatable about the longitudinal axis X (right left direction in FIG. 3). For example, as shown in FIG. 3, one planetary carrier 63 (the planetary carrier at the right side in FIG. 3) can be rotatably mounted on the casing 7 about the longitudinal axis X via a planetary bearing 62 fitted over an outer circumferential surface of the one planetary carrier 63. The other planetary carrier 63 (the planetary carrier at the left side in FIG. 3) is rotatably mounted on the power output member 61 about the longitudinal axis X via another planetary bearing 62 fitted over the outer circumferential surface of the other planetary carrier 63. Alternatively, in some embodiments of the invention, as shown in FIG. 4, two planetary carriers 63 can be rotatably mounted on the casing 7 and the power output member 61 via planetary carrier bearings 62 fitted in the central holes thereof respectively with opposing to each other.

Three planetary gears 65 are each rotatably supported on the two planetary carriers 63 respectively. For example, as shown in FIG. 3, both ends of the planetary gear shaft 654 of each planetary gear 65 are supported on the two planetary carriers 63. The three planetary gears 65 are rotatably mounted on their planetary gear shafts 654 via planetary gear bearings 655 respectively. Alternatively, the planetary gears 65 can be directly fitted over and fixed on their respective planetary gear shafts 654 and both ends of each planetary gear shaft 654 are rotatably supported on the two planetary carriers 63 via bearings respectively.

Therefore, the three planetary gears 65 can spin about their respective planetary gear shafts 654, and can also revolve about the longitudinal axis X following the two planetary carriers 63.

The annular gear 64 is fixed in the casing 7 and the three planetary gears 65 engage with the annular gear 64 respectively. For example, as shown in FIGS. 3 and 4, the annular gear 64 is fixed at the right side in the casing 7.

The power output member 61 is disposed at a left side in the casing 7 and rotatable about the longitudinal axis X. The power output member 61 is formed with an input gear portion 611 and an output gear portion 612. The input gear portion 611 engages with the three planetary gears 65 and the output gear part 612 engages with the drum 8 so as to drive the drum 8 to rotate. More specifically, the output gear portion 612 engages with a drum inner gear portion 811 formed within the axial central hole 812 of the drum 8.

Figure 2:
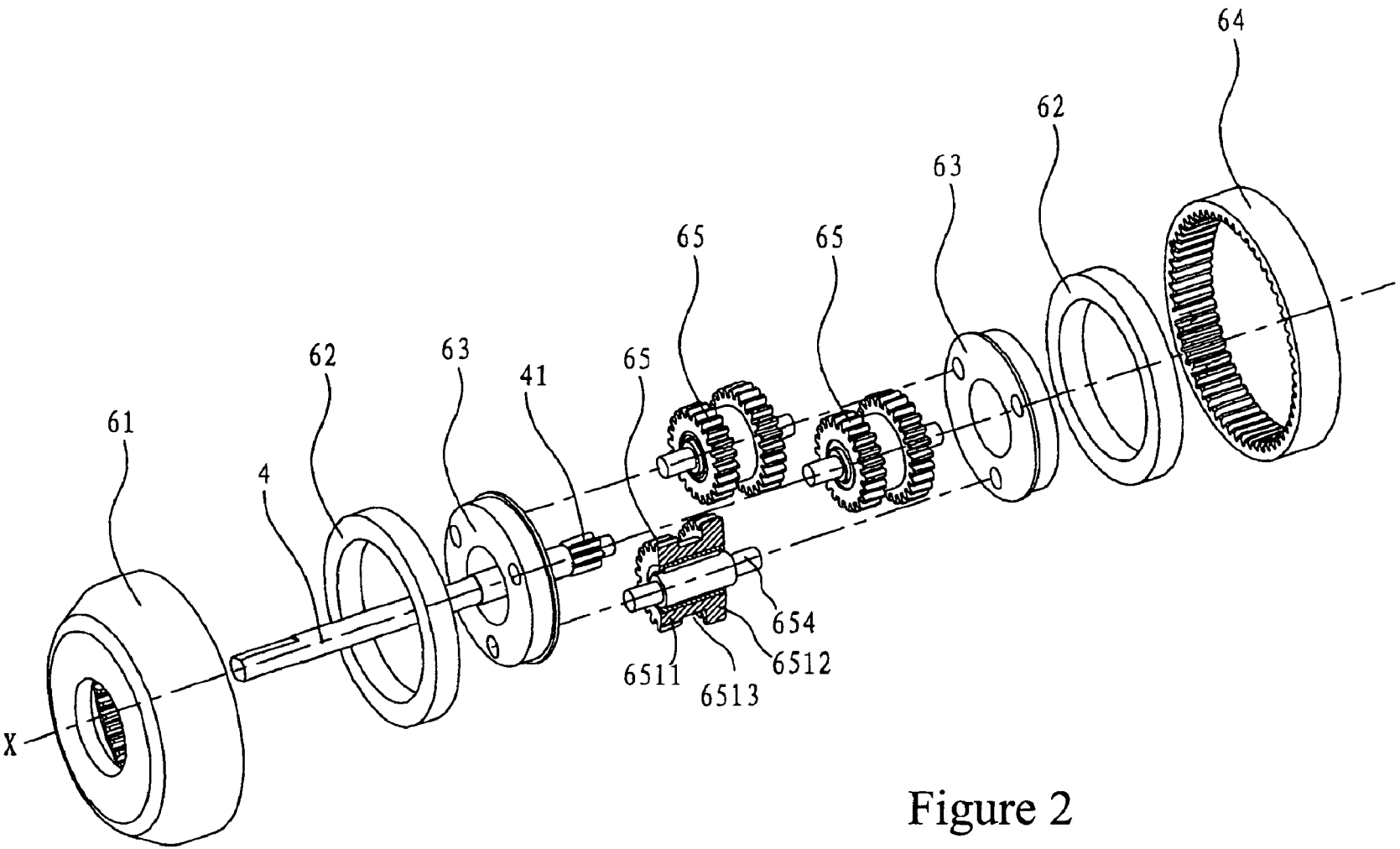
FIG. 2 is a schematic exploded view of a transmission gear shaft and a planetary mechanism assembly of the power transmission device of the winch according to one embodiment of the present invention.
Figure 7:
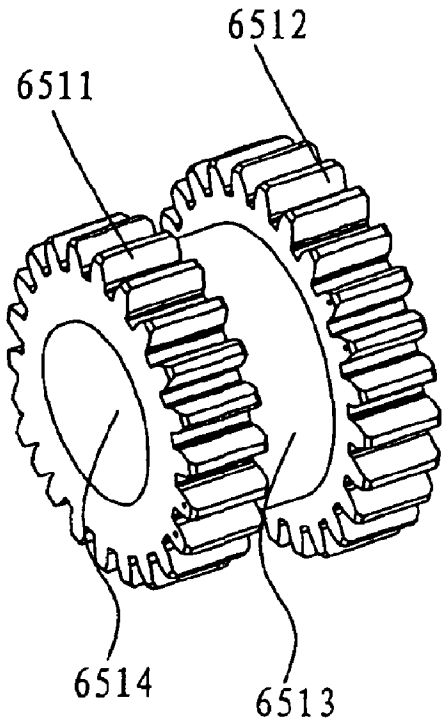
FIG. 7 is a perspective view of one of the first to third planetary gears of the winch according to one embodiment of the present invention.

According to another embodiment of the present invention, as shown in FIGS. 2 and 7, each planetary gear 65 comprises a first planetary gear portion 6511 and a second planetary gear portion 6512. In the example shown in the drawings, the first planetary gear portion 6511 and the second planetary gear portion 6512 are longitudinally spaced apart by a circumferential recessed groove 6513 formed in the outer circumferential surface of the planetary gears 65. However, the present invention is not limited to this embodiment. For example, the first planetary gear portion 6511 and the second planetary gear portion 6512 can be adjoined but have different outer diameters. The central hole 6514 of the planetary gear 65 is used for fitting over the planetary gear shaft 654. More specifically, the first planetary gear portion 6511 engages with the output gear portion 611 of the power output member 61 and the second planetary gear portion 6512 engages with the annular gear 64.

Further, according to another embodiment of the present invention, the transmission gear shaft 4 is movable with respect to the three planetary gears 65 along the longitudinal axis X under a longitudinal force F so that the transmission gear 41 can be engaged with or disengaged from the three planetary gears 65. For example, when the transmission gear shaft 4 is moved toward left under the longitudinal force F, the transmission gear 41 can face directly the circumferential recessed grooves 6513 of the planetary gear 65 and be disengaged from the planetary gear 65 (the position indicated by the dashed lines in FIGS. 3 and 4). When the transmission gear shaft 4 is moved toward right under the longitudinal force F, the transmission gear 41 can engage with the second planetary gear portion 6512 of the planetary gear 65 (the position indicated by the solid lines in FIGS. 3 and 4). However, the present invention is not limited to this embodiment. For example, the planetary gear 65 may not be divided into the first planetary gear portion 6511 and the second planetary gear portion 6512. Instead, those having ordinary skill in the art will appreciate that the transmission gear 4 can be offset from the whole planetary gear 65 so as to be disengaged from the planetary or face the planetary gear 65 so as to be engaged with the planetary gear 65 through movement. The longitudinal movement of the transmission gear shaft 4 can be achieved by any number of ways commonly known in the art.

As shown in FIGS. 3 and 4, a casing gear portion 71 is formed inside the casing 7, and the casing gear portion 71 engages with the annular gear 64 so that the annular gear 64 can be prevented from moving in the casing 7, thus improving the stability of the annular gear 64 in the casing 7.

As shown in FIGS. 3-6 and FIG. 8, the output shaft 11 of the motor 1 is connected with the proximal end 42 of the transmission gear shaft 4 through the braking device 3. The braking device 3 is disposed in the axial central hole 812 of the drum 8, so that the output shaft 11 of the motor 1 is extended into the drum 8 and connected with the proximal end 42 of the transmission gear shaft 4 through the braking device 3. The distal end of the transmission gear shaft 4 is extended into the casing 7 from the axial central hole 812 of the drum 8 so as to be connected to the planetary mechanism assembly 6 through the engagement of the transmission gear 41 with the planetary gears 65. The planetary mechanism assembly 6 is further operatively connected with the drum 8 so as to rotate the drum 8, thus transmitting the driving force from the motor 1 to the drum 8.

According to one embodiment of the invention, the braking device 3 includes a braking bush 34, a brake driving shaft 31, a brake driven shaft 35, a brake shoe 32 and an elastic member 33. The braking bush 34 is fixed in an axial central hole 812 of the drum 8. Alternatively, the braking bush 34 can also be integrally formed with the drum 8, i.e., the braking bush 34 is a part of the drum 8. For example, the braking bush 34 is formed as an annular boss on the inner circumferential wall of the axial central hole 812 of the drum 8.

Figure 5:
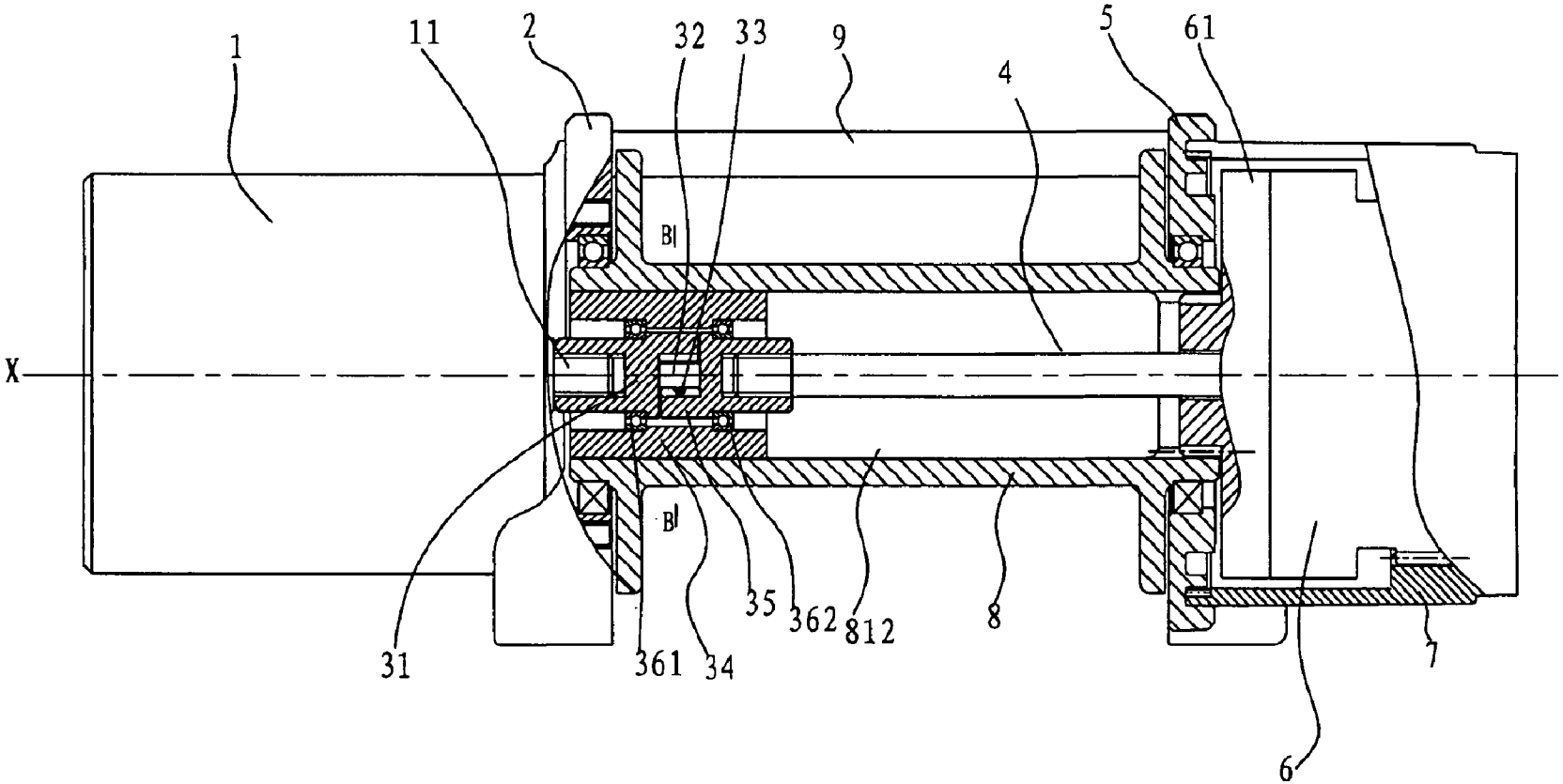
FIG. 5 is a schematic sectional view of the winch according to one embodiment of the present invention, in which a braking device of a power transmission device is illustrated in detail.
Figure 6:
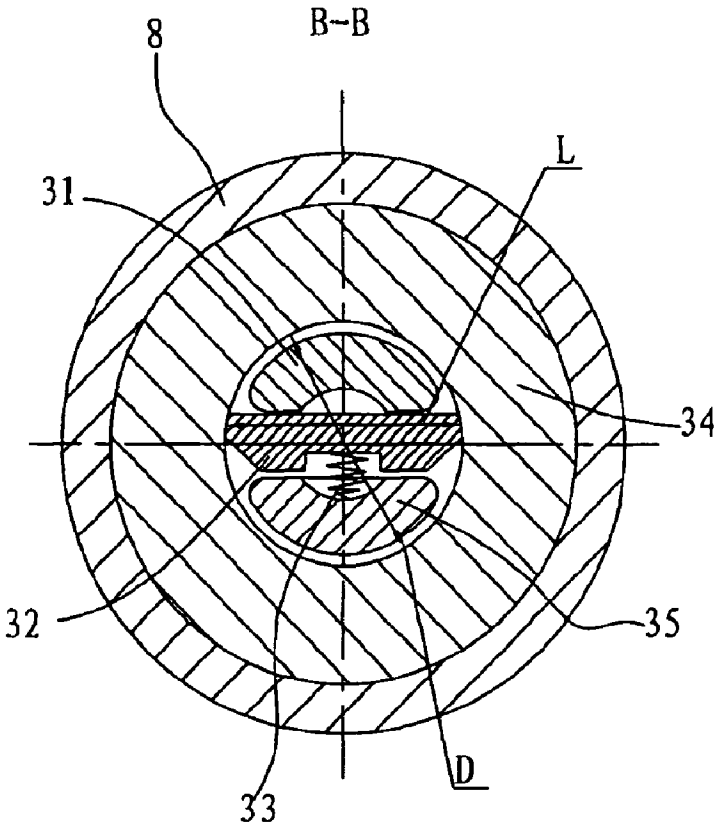
FIG. 6 is a schematic sectional view of the braking device.
Figure 8:
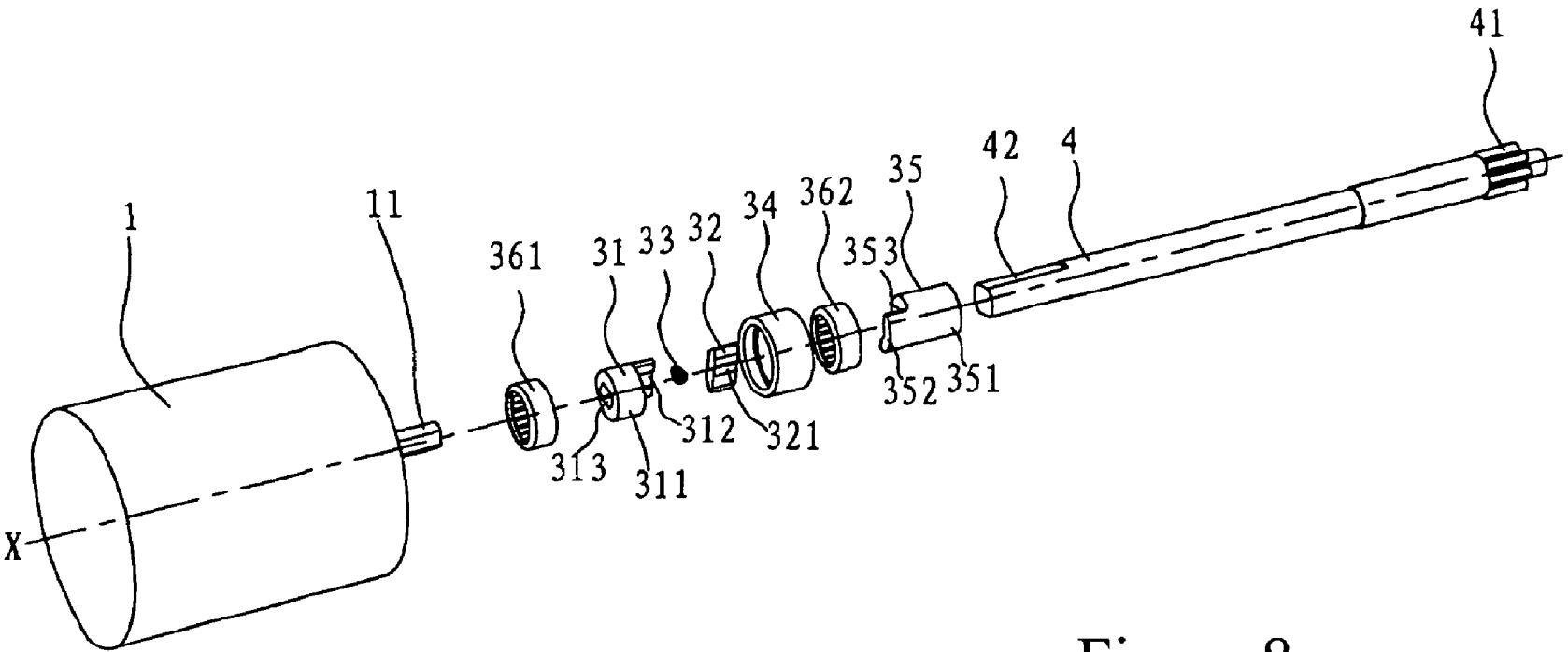
FIG. 8 is a schematic exploded view showing the braking device of the winch according to one embodiment of the present invention.

The brake driving shaft 31 is connected with the output shaft 11 of the motor 1 and rotatably disposed in the braking bush 34 via a first brake bearing 361 fitted over the outer circumferential surface 311 of the brake driving shaft 31. An end of the brake driving shaft 31 (the right end in FIG. 2) is formed with a first axial protrusion 312. As shown in FIGS. 2 and 5, the brake driving shaft 31 has a cylindrical shape which is formed with a central hole 313. The first axial protrusion 312 is integrally extended outwardly from an end surface of the brake driving shaft 31. As shown in FIGS. 6 and 8, the first axial protrusion 312 is formed to have an arc shape which is consistent with the shape of a portion of the side wall of the brake driving shaft 31.

According to one embodiment of the present invention, the cross section of the central hole 313 has a non-circular shape, such as an elliptical or rectangular shape. An end of the output shaft 11 of the motor 1 has a cross section shape adapted to the central hole 313, so that the driving force (torque) of the motor 1 can be transmitted to the braking bush 34.

The brake driven shaft 35 is, at the other end (right end in FIG. 2) thereof, connected with a proximal end 42 of the transmission gear shaft 4 and rotatably disposed in the braking bush 34 via a second brake bearing 362 fitted over the outer circumferential surface of the brake driven shaft 35. The end of the brake driven shaft 35 opposing to the brake driving shaft 34 (left end in FIG. 2) is formed with a second axial protrusion 352 opposing to the first axial protrusion 312.

As shown in FIGS. 5 and 8, the brake driven shaft 35 has a cylindrical shape which is formed with a central hole 353. The second axial protrusion 352 is integrally extended outwardly from an end surface of the brake driven shaft 35. As shown in FIGS. 6 and 8, the second axial protrusion 352 is formed as an arc shape which is consistent with a shape of a portion of the side wall of the brake driven shaft 35.

According to one embodiment of the present invention, the cross section of the central hole 353 has a non-circular shape, such as an elliptical or rectangular shape. The proximal end 42 of the transmission gear shaft 4 has a cross section shape adapted to that of the central hole 353, so that the driving force (torque) from the brake driven shaft 35 can be transmitted to the transmission gear shaft 4.

As shown in FIGS. 5 and 6, the brake shoe 32 is disposed between the first axial protrusion 312 and the second axial protrusion 352. Thus, the brake shoe 32 is sandwiched between the first axial protrusion 312 and the second axial protrusion 352. In addition, the thickness at both ends of the brake shoe 32 in the lengthwise direction decreases gradually, in which the lengthwise direction of the brake shoe 32 is consistent with the radial direction of the braking bush 34 when the brake shoe 32 is disposed in the braking bush 34. Namely, both end surfaces of the brake shoe 32 in the lengthwise direction are bevels, and transited to the top surface (the upper surface in FIG. 6) through arcs respectively. Those having ordinarily skill in the art will understand that the maximum length of the brake shoe 32 in the lengthwise direction should be slightly smaller than the inner diameter of the braking bush 34 so that the brake shoe 32 can rotate in the braking bush 34 when a maximum length part of the brake shoe 32 which is longest passes through the center of the braking bush 34.

An end of the elastic member 33 is connected to the surface (i.e., inner side face) of the second axial protrusion 352 opposing to the first axial protrusion 312, and the other end thereof is connected with the brake shoe 32 so that the brake shoe 32 is normally urged toward the first axial protrusion 312. According to one embodiment of the invention, the elastic member 33 is of a compression spring.

The winch according to one embodiment of the invention employs a braking device that has a simple structure with low manufacturing cost and high reliability. In addition, it is not apt to fail. Further, the cable can conveniently be wound or unwound and the drum 8 is easy to brake. In addition, the power transmission device uses a single stage planetary mechanism to achieve deceleration function with large speed ratio, thus the transmission ratio is high, the structure is simple with light weight and low cost. Therefore, the winch of the present invention has a simple structure, high transmitting efficiency, low cost and reliable operability. The operation of the winch of the present invention will be described below.

When the cable is needed to be wound onto the drum 8, the motor 1 rotates clockwise as shown in FIG. 6. The driving force (torque) of the motor 1 is transmitted to the brake driving shaft 31, and the brake driving shaft 31 rotates in the braking bush 34 while the first axial protrusion 312 of the brake driving shaft 31 urges the brake shoe 32 toward the second axial protrusion 352 of the brake driven shaft 35 against the elastic force of the elastic member 33.

After the braking shoe 32 moves toward the second axial protrusion 352, the maximum length portion of the braking shoe 32 passes through the center of the braking bush 34. Since the maximum length L of the braking shoe 32 is slightly smaller than the inner diameter of the braking bush 34, the braking shoe 32 can rotate in the braking bush 34 so that the first axial protrusion 312 can transmit the driving force to the second axial protrusion 352 via the braking shoe 32. The second axial protrusion 352 transmits the driving force to the transmission gear shaft 4, the three planetary gears 65, the power output member 61 and the drum 8 in turn. The three planetary gears 65 spin about their respective planetary gear shafts 655 while revolving about the longitudinal axis X following the planetary carriers 63. The first planetary gear portion 6511 of each planetary gear 65 engages with the input gear portion 611 of the power output member 61 while the second planetary gear portion 6512 engages with the annular gear 64 so that the three planetary gears 65 transfer the driving force to the power output member 61. The power output member 61 drives the drum 8 to rotate in a first direction via the output gear portion 612 engaged with the drum inner gear portion 811 so that the cable is wound onto the outer circumferential surface of the drum 8.

When the cable is needed to be unwound from the drum 8, the motor 1 rotates in an opposite direction (anticlockwise as shown in FIG. 5), the driving force of the motor 1 is transmitted to the brake driving shaft 31 (the first axial protrusion 312), the brake shoe 32, the brake driven shaft 35 (the second axial protrusion 352), the transmission gear shaft 4, the three planetary gears 65, the power output member 61 and the drum 8 in turn, so that the drum 8 rotates in a second direction opposite to the first direction and the cable is unwound from the drum 8, which is similar to the winding operation mentioned above.

When the cable is not needed to be wound onto and unwound from the drum 8, the motor 1 stops rotating. If, at this time, the drum 8 is dragged by the cable, the dragging force of the cable applied to the drum 8 is transmitted to the power output member 61, the three planetary gears 65, the transmission gear shaft 4, the brake driven shaft 35 (the second axial protrusion 352) in turn. Because the brake shoe 32 moves toward the first axial protrusion 312 under elastic force of the elastic member 33 and urging of the second axial protrusion 352 toward the first axial protrusion 312, the maximum length portion of the brake shoe 32 is offset from the center of the braking bush 34, as shown in FIG. 6. Then, both ends of the brake shoe 32 in the lengthwise direction contacts the inner wall of the braking bush 34 so that the brake shoe 32 can not be rotated in the braking bush 34 because of the friction therebetween. The second axial protrusion 352 (brake driven shaft 35) can not be further rotated, thus the torque of the second axial protrusion 352 can not be transmitted to the first axial protrusion 312 via the brake shoe 32, so that the first axial protrusion 312, thereby the drum 8, can not be rotated, and the winch is braked.

The present invention has been described in an illustrative manner. It is to be understood that the terminology that has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A winch, comprising:

a drum defining an axial central hole and being rotatable about a longitudinal axis of the axial central hole;

a motor that is longitudinally disposed at an end of the drum; and a power transmission device that is longitudinally disposed at the other end of the drum and operatively connected to the motor and the drum respectively, wherein the power transmission device includes a casing mounted at the other end of the drum, a transmission gear shaft extending longitudinally in the axial central hole of the drum, a proximal end of the transmission gear shaft being connected to the motor and a distal end thereof being provided with a transmission gear and extended into the casing;

a planetary mechanism assembly having first and second planetary carriers that are disposed in the casing and rotatable about the longitudinal axis, first to third planetary gears that are rotatably supported on the first and second planetary carriers via first to the third planetary gear shafts and engaged with the transmission gear, respectively, an annular gear fixed in the casing and engaged with the first to third planetary gears respectively, and a power output member that is disposed in the casing, rotatable about the longitudinal axis and formed with an input gear portion and an output gear portion, the input gear portion engages with the first to third planetary gears respectively, and the output gear portion engages with the drum.

2. The winch as set forth in claim 1, wherein each of the first to third planetary gears comprises a first planetary gear portion and a second planetary gear portion, wherein the first planetary gear portions of the first to third planetary gears engage with the annular gear and the second planetary gear portions thereof engage with the input gear portion, respectively.

3. The winch as set forth in claim 1, wherein the transmission gear shaft is movable with respect to the first to third planetary gears along the longitudinal axis so that the transmission gear can engage with or disengage from the first to third planetary gears.

4. The winch as set forth in claim 1, wherein both ends of each of the first to third planetary gear shafts are fixed in the first and the second planetary carriers, and the first to third planetary gears are mounted on the first to third planetary gear shafts via first to third planetary gear bearings, respectively.

5. The winch as set forth in claim 1, wherein the first planetary carrier is rotatably mounted on the power output member via a first planetary carrier bearing fitted over an outer circumferential surface of the first planetary carrier or fitted within a central hole of the first planetary carrier, and wherein the second planetary carrier is rotatably mounted on the casing via a second planetary carrier bearing fitted over an outer circumferential surfaces of the second planetary carrier or fitted within a central hole of the second planetary carrier.

6. The winch as set forth in claim 1, wherein the transmission gear is integrally formed with the transmission gear shaft.

7. The winch as set forth in claim 1, wherein the casing is formed with a casing gear portion therein and the casing gear portion engages with the annular gear.

8. The winch as set forth in claim 1, wherein the output shaft of the motor is connected with the transmission gear shaft through a braking device.

9. The winch as set forth in claim 8, wherein the braking device includes:

a braking bush fixed in the axial central hole of the drum;

a brake driving shaft having an end that is connected to an output shaft of the motor, and the other end thereof being rotatably disposed in the braking bush and formed with a first axial protrusion;

a brake driven shaft, an end of which being rotatably disposed in the braking bush and formed with a second axial protrusion opposing to the first axial protrusion, and the other end thereof being connected with the transmission gear shaft;

a brake shoe being disposed between the first axial protrusion and the second axial protrusion; and an elastic member, an end of which being connected to a surface of the second axial protrusion opposing to the first axial protrusion, and the other end thereof being connected to the brake shoe and normally urging the brake shoe toward the first axial protrusion.

10. The winch as set forth in claim 9, wherein the elastic member includes a compression spring.

* * * * *